US009523055B2

(12) United States Patent
Russeff

(10) Patent No.: US 9,523,055 B2
(45) Date of Patent: Dec. 20, 2016

(54) NATURAL GAS LIQUIDS STABILIZER WITH SIDE STRIPPER

(71) Applicant: UOP LLC, Des Plaines, IL (US)

(72) Inventor: Richard L. Russeff, Bartlesville, OK (US)

(73) Assignee: UOP LLC, Des Plaines, IL (US)

( * ) Notice: Subject to any disclaimer, the term of this patent is extended or adjusted under 35 U.S.C. 154(b) by 170 days.

(21) Appl. No.: 14/606,431

(22) Filed: Jan. 27, 2015

(65) Prior Publication Data

US 2015/0219394 A1 Aug. 6, 2015

Related U.S. Application Data

(60) Provisional application No. 61/934,182, filed on Jan. 31, 2014.

(51) Int. Cl.

| | |
|---|---|
| ***C10L 3/12*** | (2006.01) |
| ***C10G 5/06*** | (2006.01) |
| ***C10G 7/02*** | (2006.01) |
| ***C10G 65/00*** | (2006.01) |
| ***C10L 1/06*** | (2006.01) |

(52) U.S. Cl.

CPC . *C10L 3/12* (2013.01); *C10G 5/06* (2013.01); *C10G 7/02* (2013.01); *C10G 65/00* (2013.01); *C10L 1/06* (2013.01); *C10G 2300/104* (2013.01); *C10G 2400/26* (2013.01); *C10L 2200/0415* (2013.01); *C10L 2290/543* (2013.01)

(58) Field of Classification Search

None

See application file for complete search history.

(56) References Cited

U.S. PATENT DOCUMENTS

| | | | | | |
|---|---|---|---|---|---|
| 4,430,103 | A * | 2/1984 | Gray | F25J 1/004 | 62/612 |
| 4,696,688 | A * | 9/1987 | Mehra | C07C 7/11 | 62/625 |
| 5,680,775 | A * | 10/1997 | Manley | F25J 3/0219 | 62/630 |
| 7,267,746 | B1 * | 9/2007 | Harris | B01D 3/141 | 196/111 |
| 2006/0032269 | A1 * | 2/2006 | Cuellar | F25J 3/0209 | 62/620 |
| 2007/0012072 | A1 * | 1/2007 | Qualls | F25J 1/0022 | 62/613 |
| 2009/0221864 | A1 * | 9/2009 | Mak | F25J 3/0214 | 585/803 |
| 2009/0293537 | A1 * | 12/2009 | Ameringer | F25J 3/0209 | 62/620 |
| 2015/0308735 | A1 * | 10/2015 | Thom | F25J 3/0209 | 62/623 |

* cited by examiner

*Primary Examiner* — Tam M Nguyen

(57) ABSTRACT

The invention provides a process and system for processing natural gas and separating natural gas liquids into natural gasoline and a Y-grade liquid that meets specifications for low methane and ethane content. The process and system includes a side stripper and reboiler to separate methane and ethane from heavier hydrocarbons and a reboiler system to stabilize the natural gasoline.

4 Claims, 2 Drawing Sheets

NATURAL GAS LIQUIDS STABILIZER WITH SIDE STRIPPER

CROSS-REFERENCE TO RELATED APPLICATION

This application claims priority from Provisional Application No. 61/934,182 filed Jan. 31, 2014, the contents of which are hereby incorporated by reference.

BACKGROUND OF THE INVENTION

Liquid in the feed to natural gas liquid (NGL) recovery units varies dramatically with ambient conditions. Traditional stabilizers and recycle compressors can become overwhelmed with the condensables in the feed (ethane, propane, butanes, i-pentane) that is rejected from gasoline stabilizers. This causes unstabilized gasoline to be sent to atmospheric tanks to "weather off" the volatile organic compounds (VOC). This is a loss of product and a safety hazard. Excessively large and expensive compressors increase capital costs dramatically if the compressor is sized to handle the full load of vapor from the stabilizer when ambient conditions cause large amounts of condensation. A side stripper on the stabilizer is much cheaper, more reliable, and less expensive to maintain. Mechanical inlet feed chilling (rich gas conditioning) also produces much more condensation and requires a larger stabilizer overhead compressor. A side stripper and NGL recovery system in the stabilizer keeps the recompression size to a minimum. The goal of the downstream NGL unit is to recover the liquids. By recovering more liquids prior to the NGL unit, capacity of the overall plant is increased.

Natural gas that comes from gas wells and other sources consists primarily of methane and contains varying amounts of heavier hydrocarbons including ethane, propane, normal butane, isobutane, pentanes and even higher molecular weight hydrocarbons. When these heavier hydrocarbons are processed and purified into finished byproducts, all of these are collectively referred to as NGL (natural gas liquids).

NGL recovery units have various sources of feed stock with different compositions. Rich gases such as well head gas, contain some amounts of natural gasoline (mostly pentanes and heavier hydrocarbons with smaller amounts of C6 and C6+ hydrocarbons). These heavier hydrocarbons condense in surge drums that feed GSP (gas subcooled process) plants that range in magnitude from "drips" to "slugs" of liquid. These liquids need to be stabilized to product specifications to be marketable. Compression units that increase the gas pressure to pipeline pressure also induce liquid condensations that also must be stabilized. Additionally, the feed to NGL recovery plants is cooled to condense the liquids prior to entering the NGL plants to increase the capacity of the NGL recovery unit (rich gas conditioning).

Along with the natural gasoline that can be recovered, significant amounts of other NGL material are condensed with the natural gasoline, thus the need for stabilization.

Conventional natural gasoline stabilization is accomplished by depressurizing the liquid and feeding it to a reboiled stripper column. Stabilized, natural gasoline is produced at the tower bottoms while the vapor is recompressed and recycled back to the NGL unit.

Ambient conditions and its effects on the pipeline temperature vary the amount of condensed material and the composition. Feed gas temperature affects the several key components that condense and affect the duty of the recycle compressor—mainly butanes and i-pentane. In winter conditions at 16° to 27° C. (60° to 80° F.) at pipeline pressures, significant amounts of butanes and i-pentane can condense prior to entering the NGL plant. These are the light-key components of natural gasoline stabilizers and have the largest effect on Reid Vapor Pressure (RVP). These components must be reboiled off of the gasoline to make an acceptable product.

If large quantities of propane, butanes, and i-pentane are condensed into the stabilizer feed, they must be rejected via the overhead vapor of the stabilizer, recompressed, and fed to the NGL recovery plant. Condensing these species may be the result of ambient conditions, compression, or inlet chilling. The recycle of these species causes the duty of the recompression to increase dramatically.

Since cooler conditions can overwhelm conventional stabilizer liquid and stabilizer off gas compressors, the gasoline from the bottom of the stabilizers may not be stabilized. Gasoline is typically sent to atmospheric tanks. If the stabilization system is overwhelmed, the unstabilized gasoline is still sent to the storage tanks where the volatile components are allowed to evaporate to the atmosphere prior to sale. This is not only a loss of valuable product, but create high VOC emissions along with serious safety hazards since many of these components are heavier than air and can produce grade level clouds waiting for an ignition source.

The ethane, propane, butanes, and i-pentane that are condensed as part of the liquid are the target of the downstream NGL recovery unit in liquid form—the goal of NGL. Since these species are already condensed upstream of the NGL unit, they can be harvested at the stabilizer, stabilized to NGL specifications, and pumped to product. The harvesting of these species in the liquid stabilization feed treatment accomplishes several key goals.

Recycling these species as off gas from conventional stabilizers dramatically increases the size of the recompression required. Compressors are expensive to purchase, maintain, and operate. Harvesting these species at the stabilizer decreases the compressor size with the addition of minimal, inexpensive equipment.

Vapor loadings in the top section of the stabilizer are decreased since the off gas species are captured.

The downstream NGL plant capacity is increased due to upstream removal of NGL product in the stabilizer.

The gasoline in on-site storage tanks are at vapor pressure specification and do not pose a safety or environmental hazard.

The vapor side draw with the cooler and side stripper capture the NGL product that is being recycled to the downstream NGL plant. The reboiled side stripper allowed the operator to control the product specifications of the NGL that is condensed from the vapor side draw. The extended downcomer weir in the stabilizer provides the static head of liquid and the necessary back pressure to force the vapor to the side stripper. Both NGL and natural gasoline products are sent to storage. And minimal off gas is sent to the downstream NGL recovery unit, freeing up its capacity.

The application for the side stripped stabilizer is on the feed to NGL recovery plants where there is liquid that collects in the upstream feed surge drum—either because of induced mechanical refrigeration, ambient temperature causing condensation, or feedstock changes. Additionally, compression from well-head gas causes creates condensate that also must be fed to a stabilizer.

In the present invention, removal of the ethane, propane, butanes, and i-pentane is accomplished by targeting the vapor boiled off of the bottoms product at the reboiler using a vapor side-draw. A butane side-draw was utilized in the HF Alkylation processes in the Isostripper (UOP) or depropanizer.

In hydrofluoric acid processes, the vapor is drawn from a column at a point a few trays/stages above the reboiler. The bottoms product of the tower(s) is stabilized, high octane gasoline. The vapors that are stripped from the bottoms product are high in n-butane. These vapors are condensed and sent out as a blending product or to isomerization units. However, there is not a need to stabilize the n-butane.

In a natural gas liquids stabilizer, there are much lighter components that prevent the vapor from being a commercially viable product (Y-Grade). Therefore, these vapors need to be stabilized after they are condensed to typical NGL specifications (E.G.-methane <0.5 (LV) % of hydrocarbon, methane <1.5 (LV) % of ethane. Typical Y-grade composition (by weight for liquids, by volume for gases) is 3-20% ethane, 35-55% propane, 7-25% isobutane, 8-25% n-butane, 5-15% iso-pentane, 5-15% n-pentane, 10-50% hexane plus and 0-3% methane. The Y-grade composition is for liquefied petroleum gas.

The total vapor side-draw from the stabilizer feeds an air-cooled partial condenser. The cooled mixed phase feeds the side stripper where the quality of the bottoms product is controlled to specification by a reboiler. The stabilizer with a side stripper is shown in the drawings.

Since the total vapor side draw removes all of the vapor from the stabilizer, a total liquid trap tray with a tall downcomer is present on the stage above the vapor draw. The static head of clear liquid backup overflowing the weir provides the required pressure drop to force the vapor through the side draw cooler. Design margin is considered for the liquid static head above the pressure drop of the air cooler to ensure that vapors do not back up the downcomer. The partially condensed vapor from the side draw must be free draining to the side stripper to minimize pressure losses. The theoretical stages required for stabilization of the gasoline from the stabilizer and the NGL from the side stripper, these columns are short in length. And due to the free draining requirement from the air cooler to the side stripper, both tower bases and be close to grade. Only the air cooler is required to be elevated such that it free drains to the side stripper.

The side stripper overhead returns to the stabilizer above the liquid backup tray and provides vapor traffic to stripe light components in the liquid feed to the stabilizer. Additionally, the side stripper off gas contains some C2+ material that can be recovered in the liquid traffic going down the Stabilizer for another chance at harvesting in the stabilizer/side stripper system.

The off-gas from the stabilizer is recompressed and sent to the downstream NGL recovery unit, as it is with conventional stabilizers.

The stabilizer can be built in modular format along with the side stripper. Since gas compositions can change, different stabilizers can be fitted with different side stripper depending on the NGL and gasoline loadings.

Since the side stripper and additional tangent length required on the stabilizer for the side draw configuration is small relative to a large recycle compressor, the configuration is much more economical than conventional stabilizers. A detailed economic analysis still needs to be conducted. A relative perspective is that the stabilizer for scale of this study is 46 to 61 cm (18 to 24 inches) in diameter. Adding the side stripper configuration can reduce the recycle compressor requirements from the range of 500-1000 hp to about 80 hp.

The stabilizer net bottom has several uses that are potential for further development.

Since the stabilizer bottom is relatively hot, it must be cooled prior to sending to tankage. This heat can be recovered by using the hot product to reboil the side stripper as a heat medium. Very little duty is required to reboil the side stripper relative to the duty of the stabilizer. The reboiler outlet temperatures of the stabilizer and side stripper (204° C. (400° F.) and 54° C. (130° F.), respectively) provide ample approach temperatures to facilitate the heat integration.

Additionally, the stabilizer net bottom is excellent lean oil for absorption once it is cooled via air cooler. Utilizing this lean oil can be as simple as injecting (recycling) a small stream of it into the upstream feed surge drum to capture more propane and butane in the liquid feeding the stabilizer system. Or it can be used in a lean oil absorber tower to treat the feed to the unit in lieu of a feed surge drum.

SUMMARY OF THE INVENTION

In one embodiment, the present invention relates to a process for processing a stream containing natural gas liquids comprising: sending said stream to a column; removing a vapor comprising methane and ethane from a top of said column; removing a portion of said stream from a middle section of said column and sending said portion to a side stripper to separate said middle portion into a light hydrocarbon vapor portion and a natural gas liquid product; and removing a second portion of said stream from a bottom section of said column and sending said second portion to a stabilizer reboiler to separate said second portion into a stabilized gasoline product and a lighter hydrocarbon vapor portion to be returned to said column.

DETAILED DESCRIPTION OF THE INVENTION

Figure 1:
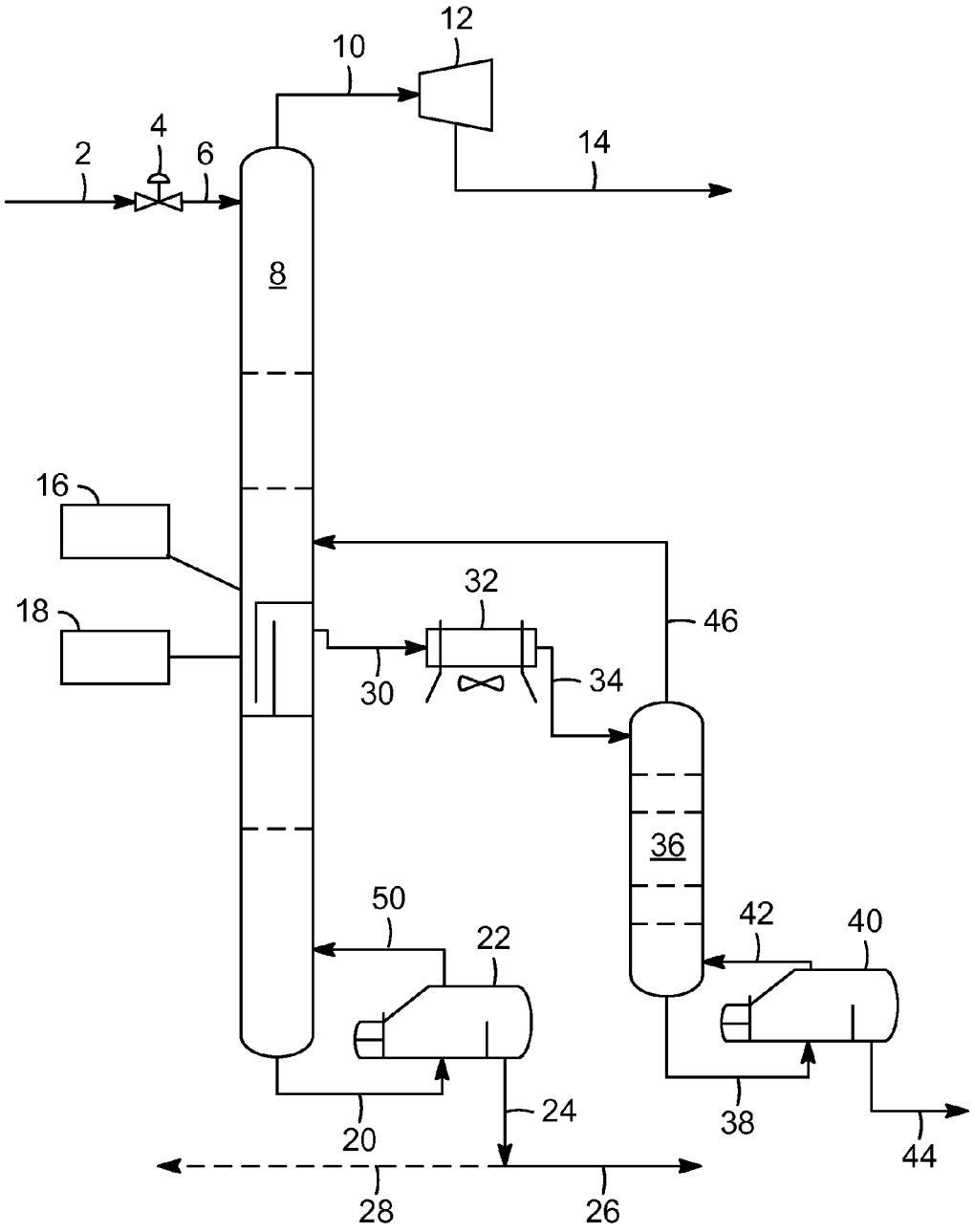
FIG. 1 shows a column for separating a hydrocarbon stream into a light hydrocarbon stream, a side stripper for treating natural gas liquids including propanes and butanes and a stabilizer reboiler for stabilizing natural gasoline

FIG. 1 displays an illustrative flow scheme of the present invention with a condensed liquid high pressure stream 2 containing hydrocarbons that passes valve 4 to line 6 to enter column 8. Off gas 10 exits the top of column 8 into line 10 to stabilizer off gas compressor 12 and then in line 14 to NGL recovery unit (not shown). A blank tray (not active surface) 16 is shown near the middle of the column and a liquid backup weir 18 is shown to help in separating vapors and liquids. A total vapor side draw is removed in line 30, passing to side draw air cooler 32 with a free drain 34 then passing to side stripper 36. A bottom stream 38 exits side stripper 36 and then goes to side stripper reboiler 40. A liquid portion 44 exits as a NGL y-grade liquid and a vapor portion 42 is returned to side stripper 36. Natural gasoline 20 exits the bottom of the column and is sent to a stabilizer reboiler 22 to remove lighter components 50 that are returned to the column and natural gasoline 24 that is now stabilized can be divided into two portions 26 and 28.

Figure 2:
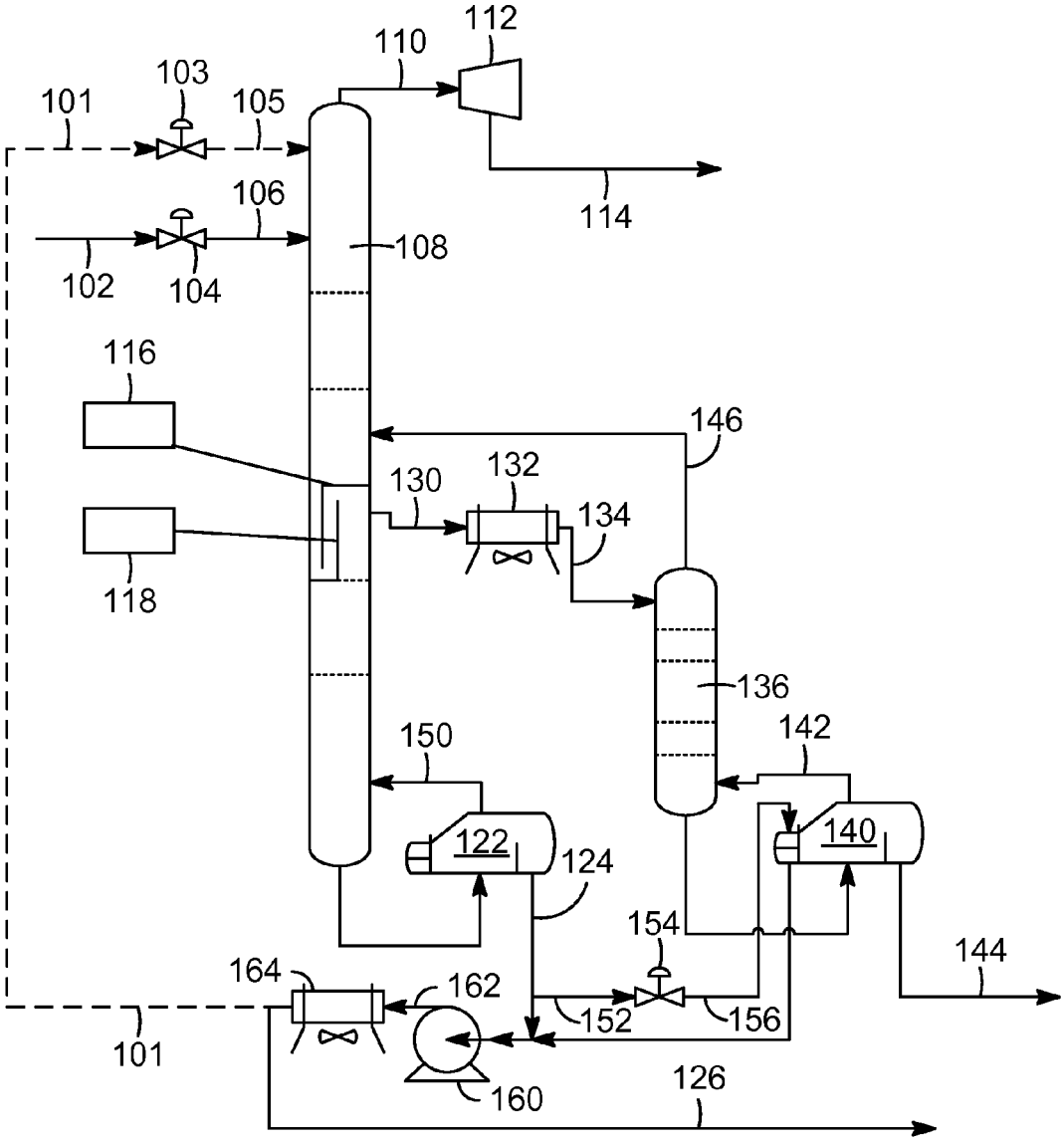
FIG. 2 shows an alternate design in which the side stripper and the stabilizer reboiler units shown in FIG. 1 are connected.

FIG. 2 displays an alternative flow scheme of the present invention. A condensed liquid high pressure stream 102 containing hydrocarbons that passes valve 104 to line 106 to enter column 108. In addition, lean oil 101 enters column 108 after passing through valve 103 and line 105. Off gas 110 exits the top of column 108 into line 110 to stabilizer off gas compressor 112 and then in line 114 to NGL recovery unit (not shown). A blank tray (not active surface) 116 is shown near the middle of the column and a liquid backup weir 118 is shown to help in separating vapors and liquids. A total vapor side draw is removed in line 130, passing to side draw air cooler 132 with a free drain 134 then passing to side stripper 136. A bottom stream 138 exits side stripper 136 and then goes to side stripper reboiler 140. A liquid portion 144 exits as a NGL y-grade liquid and a vapor portion 142 is returned to side stripper 136. Natural gasoline 120 exits the bottom of the column and is sent to a stabilizer reboiler 122 to remove lighter components 150 that are returned to the column and natural gasoline 124 that is now stabilized can be divided into two portions 126 and 128. A portion 152 of natural gasoline 124 is sent to valve 154 and then through line 156 to side stripper reboiler 140. A heavier portion of the mixture processed in side stripper reboiler 140 is sent in line 158 to a pump 160 through an air cooler 164 to stabilized gas products 126 and 128.

SPECIFIC EMBODIMENTS

While the following is described in conjunction with specific embodiments, it will be understood that this description is intended to illustrate and not limit the scope of the preceding description and the appended claims.

A first embodiment of the invention is a process for processing a stream containing natural gas liquids comprising (a) sending the stream to a column; (b) removing a vapor comprising methane and ethane from a top of the column; (c) removing a portion of the stream from a middle section of the column and sending the portion to a side stripper to separate the middle portion into a light hydrocarbon vapor portion and a natural gas liquid product; and (d) removing a second portion of the stream from a bottom section of the column and sending the second portion to a stabilizer reboiler to separate the second portion into a stabilized gasoline product and a lighter hydrocarbon vapor portion to be returned to the column. An embodiment of the invention is one, any or all of prior embodiments in this paragraph up through the first embodiment in this paragraph wherein the second portion of the stream contacts a liquid backup weir before exiting the column and being sent to the stabilizer reboiler.

A second embodiment of the invention is a system for processing a stream containing natural gas liquids comprising; (a) a column for separating the stream into a vapor portion, a middle portion comprising propanes and butanes and a bottom portion containing natural gasoline; (b) a side stripper connected to a middle portion of the column and a side stripper reboiler for separating the propanes and butanes from lighter hydrocarbons and (c) a stabilizer reboiler for removing lighter hydrocarbons from the natural gasoline. An embodiment of the invention is one, any or all of prior embodiments in this paragraph up through the second embodiment in this paragraph wherein a propane/butane stream exits the side stripper reboiler that comprises methane less than 0.5 (LV) % of the propane/butane stream and wherein the methane is less than 1.5 (LV) % of ethane within the propane/butane stream.

Without further elaboration, it is believed that by using the preceding description, one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for processing a stream containing natural gas liquids comprising:

(a) sending said stream to a column;

(b) removing a vapor comprising methane and ethane from a top of said column;

(c) removing a portion of said stream from a middle section of said column and sending said portion to a side stripper to separate said middle portion into a light hydrocarbon vapor portion and a natural gas liquid product; and (d) removing a second portion of said stream from a bottom section of said column and sending said second portion to a stabilizer reboiler to separate said second portion into a stabilized gasoline product and a lighter hydrocarbon vapor portion to be returned to said column.

2. The process of claim 1 wherein said second portion of said stream contacts a liquid backup weir before exiting said column and being sent to said stabilizer reboiler.

3. The process of claim 1 wherein said stabilized gasoline product is a natural gasoline.

4. The process of claim 1 wherein said natural gas liquid product is a Y-grade natural gas liquid.

* * * * *